US011297899B2

(12) United States Patent
Liu

(10) Patent No.: US 11,297,899 B2
(45) Date of Patent: Apr. 12, 2022

(54) TUNABLE RIGIDITY INSOLE WITH INTERCHANGEABLE STIFFENERS

(71) Applicant: Yi Hsien Liu, Taipei (TW)

(72) Inventor: Yi Hsien Liu, Taipei (TW)

( * ) Notice: Subject to any disclaimer, the term of this patent is extended or adjusted under 35 U.S.C. 154(b) by 129 days.

(21) Appl. No.: 15/919,493

(22) Filed: Mar. 13, 2018

(65) Prior Publication Data

US 2019/0125032 A1 May 2, 2019

(30) Foreign Application Priority Data

Oct. 27, 2017 (TW) ..... 106137063

(51) Int. Cl.

| | |
|---|---|
| ***A43B 17/04*** | (2006.01) |
| ***A43B 7/142*** | (2022.01) |
| ***A43B 7/143*** | (2022.01) |
| ***A43B 7/1445*** | (2022.01) |
| ***A43B 7/1464*** | (2022.01) |
| ***A43B 23/00*** | (2006.01) |

(52) U.S. Cl.

CPC ..... *A43B 17/04* (2013.01); *A43B 7/142* (2013.01); *A43B 7/143* (2013.01); *A43B 7/1445* (2013.01); *A43B 7/1464* (2022.01); *A43B 23/00* (2013.01)

(58) Field of Classification Search

CPC ..... A43B 7/142; A43B 7/143; A43B 7/1465; A43B 7/28; A43B 17/02; A43B 17/04

USPC ..... 36/155–164

See application file for complete search history.

(56) References Cited

U.S. PATENT DOCUMENTS

| | | | | | |
|---|---|---|---|---|---|
| 2,713,732 | A * | 7/1955 | Guest | A43B 7/14 | 36/167 |
| 3,780,742 | A * | 12/1973 | Madgy | A43B 7/142 | 36/147 |
| 3,841,005 | A * | 10/1974 | Cox | A43B 13/42 | 36/76 C |
| 4,420,894 | A * | 12/1983 | Glassman | A43B 13/28 | 36/107 |
| 4,606,139 | A * | 8/1986 | Silver | A43B 13/36 | 36/100 |

(Continued)

*Primary Examiner* — Shaun R Hurley
*Assistant Examiner* — Bao-Thieu L Nguyen
(74) *Attorney, Agent, or Firm* — Bradley J. Thorson; DeWitt LLP

(57) ABSTRACT

A tunable rigidity insole with interchangeable stiffeners includes an arch pad main body and three rigid stiffeners. The arch pad main body includes a set of first to third engaging holes, and at least one or two of these three rigid stiffeners will be selected to assemble into the engaging holes on the arch pad main body. The three rigid stiffeners provide supports to lateral longitudinal, central and medial longitudinal arch portions respectively. The first, second and third rigid stiffeners have at least two engagement members for each stiffener, and the engagement members have engagement extensions with a partial length component toward another engagement extensions at the end of stiffeners thereof respectively. The engagement members engage with the arch pad main body corresponding to the engaging holes respectively. By selecting and assembling different stiffeners, the present invention can have different rigidities of arch supports to match with various foot biomechanics and gait types in order to provide different arch supports thereto properly.

15 Claims, 19 Drawing Sheets

(56) References Cited

U.S. PATENT DOCUMENTS 4,785,557 A * 11/1988 Kelley ..... A43B 13/12 36/30 R
6,163,938 A * 12/2000 Weber-Unger ..... A41F 1/002 24/303
7,036,245 B2 * 5/2006 Russell ..... A43B 7/1415 36/29
7,421,808 B2 * 9/2008 Baier ..... A43B 13/12 36/107
9,839,260 B1 * 12/2017 Chang ..... A43B 17/035
10,136,698 B2 * 11/2018 Granger ..... A43B 7/142
2002/0014024 A1 * 2/2002 Gardiner ..... A43B 7/141 36/155
2004/0055180 A1 * 3/2004 Manz ..... A43B 21/26 36/25 R
2005/0091881 A1 * 5/2005 Burgess ..... A43B 5/00 36/30 R
2006/0026864 A1 * 2/2006 Arbeiter ..... A43B 7/144 36/29
2006/0059726 A1 * 3/2006 Song ..... A43B 7/142 36/142
2006/0201028 A1 * 9/2006 Chan ..... A43B 7/142 36/28
2006/0288613 A1 * 12/2006 Lo ..... A43B 7/1415 36/44
2007/0017122 A1 * 1/2007 Feller ..... A43B 1/0072 36/35 R
2007/0033834 A1 * 2/2007 Cheskin ..... A43B 7/141 36/44
2007/0107261 A1 * 5/2007 Cheskin ..... A43B 17/02 36/44
2007/0234590 A1 * 10/2007 Morales ..... A43B 7/1445 36/24.5
2009/0172972 A1 * 7/2009 Rosen ..... A43B 7/1465 36/91
2010/0050322 A1 * 3/2010 Zagula ..... A41B 11/006 2/239
2010/0218397 A1 * 9/2010 Nishiwaki ..... A43B 7/142 36/28
2010/0275468 A1 * 11/2010 Shelton ..... A43B 7/141 36/3 B
2011/0099845 A1 * 5/2011 Miller ..... A43B 7/142 36/91
2011/0126422 A1 * 6/2011 Vattes ..... A43B 7/144 36/10
2012/0159814 A1 * 6/2012 Smith ..... A43B 1/0081 36/92
2012/0246971 A1 * 10/2012 Donzis ..... A43B 7/1425 36/43
2013/0118032 A1 * 5/2013 Raji ..... A43B 1/0027 36/100
2013/0160331 A1 * 6/2013 Burke ..... A43B 1/0081 36/25 R
2013/0312280 A1 * 11/2013 Gardiner ..... A43B 1/0009 36/43
2014/0075779 A1 * 3/2014 Bruce ..... A43B 13/20 36/29
2014/0259752 A1 * 9/2014 Feldman ..... A43B 7/144 36/43
2015/0157085 A1 * 6/2015 Lee ..... A43B 7/141 36/103
2015/0201702 A1 * 7/2015 Paul ..... A43B 17/02 36/44
2015/0264998 A1 * 9/2015 Berggren ..... A43B 7/142 36/31
2015/0327624 A1 * 11/2015 Grott ..... A43B 7/14 36/91
2016/0021972 A1 * 1/2016 Grelle ..... A43B 7/1415 36/140
2016/0074614 A1 * 3/2016 Huddart ..... A61M 16/0666 128/204.18
2016/0213094 A1 * 7/2016 Matsui ..... A43B 13/12
2017/0079373 A1 * 3/2017 Huard ..... A43B 13/026
2017/0224050 A1 * 8/2017 Schouwenburg .... A43B 7/1435
2017/0318898 A1 * 11/2017 Totty ..... A43B 7/141
2018/0000196 A1 * 1/2018 Lovell ..... A43B 7/1445
2018/0008002 A1 * 1/2018 Yick ..... A43B 7/14
2018/0103717 A1 * 4/2018 Tsai ..... A43B 7/142
2018/0110291 A1 * 4/2018 Granger ..... A43B 17/006
2018/0140040 A1 * 5/2018 Granger ..... A43B 7/142
2018/0140043 A1 * 5/2018 Farris ..... A43B 13/141
2018/0153253 A1 * 6/2018 Ward ..... A43B 13/186
2018/0192739 A1 * 7/2018 Granger ..... A43B 7/142
2018/0255872 A1 * 9/2018 Manasiya ..... A43B 17/035
2020/0029653 A1 * 1/2020 Yang ..... A43B 7/141
2020/0046063 A1 * 2/2020 Salmon ..... A43B 3/122
2020/0085138 A1 * 3/2020 Hughes ..... A43B 17/14

* cited by examiner

TUNABLE RIGIDITY INSOLE WITH INTERCHANGEABLE STIFFENERS

FIELD OF THE INVENTION

The present invention relates to an insole, particularly, to an insole capable of providing different tunable foot arch supports to match with different foot biomechanics by choosing any one or two from these three different stiffeners to engage with the arch pad main body.

BACKGROUND OF THE INVENTION

The previous so-called arch insole is divided into two types in general, medium to high arch and medium to low arch according to anatomic shape of a sole. Therefore the insoles can be divided into high arch type and low arch type in order to provide proper fit to corresponding customers. In addition, the insoles can also be divided into three arch types for high arch, medium arch (or said neutral arch) and low arch (or called flat-foot) according to the anatomic shape of a sole for different customers correspondingly. However, only one of the three insoles can be provided to different users due to the specific function and structure of the three different arch insoles; consequently, it require three types of production molds during the manufacturing process and a large amount of inventory needed for different arch types of customers in the retail shops.

In addition, if need to strengthen the force further to support a heavier weight bearing, the three different fixed arch types of insole are not able to provide additional rigidity to enhance the arch support easily.

The inventor of the present invention discloses a solution to provide a single arch pad main body and three types of interchangeable stiffeners. By doing so, the rigidity can be adjusted easily with less material in view of the disadvantage of the previous art in order to satisfy the needs for different arch supports. In addition, the tunable rigidity insole with interchangeable stiffeners of the present invention includes the advantages of reducing the quantity of the production molds used during the manufacturing process as well as lowering the inventory and material cost. Furthermore, the present invention is capable of keeping a close contact between the stiffener and the arch pad main body while the insole is bent by loading with weight. The present invention provides the effect with a strengthened supporting force to the lateral longitudinal arch, medial longitudinal arch and the central arch area.

SUMMARY OF THE INVENTION

The present invention provides a tunable rigidity insole with interchangeable stiffeners comprising an arch pad main body, a first rigid stiffener, a second rigid stiffener and a third rigid stiffener. The arch pad main body includes a plurality of first engaging holes, a plurality of second engaging holes and a plurality of third engaging holes. At least one of the first rigid stiffener, the second rigid stiffener and the third rigid stiffener is assembled into the arch pad main body, after assembling, the first rigid stiffener supports a lateral longitudinal arch of a sole, the second rigid stiffener supports a central arch area of the sole, and the third rigid stiffener supports a medial longitudinal arch of the sole. The first rigid stiffener includes at least two first engagement members, the second rigid stiffener includes at least two second engagement members, the third rigid stiffener includes at least two third engagement members. At least one of the first engagement members includes a first engagement extension having at least a partial length component of the first engagement extension toward another one of the first engagement extension at an end of the first engagement member, at least one of the second engagement member includes a second engagement extension having at least a partial length component of the second engagement extension toward another one of the second engagement extension at an end of the second engagement member, and at least one of the third engagement member includes a third engagement extension having at least a partial length component of the third engagement extension toward another one of the third engagement extension at an end of the third engagement member. The first, second and third engagement members of the first, second and third rigid stiffeners correspond to the first, second and third engaging holes respectively in order to be engaged with the arch pad main body.

In a preferred embodiment, wherein the first rigid stiffener, the second rigid stiffener and the third rigid stiffener include a first axis, a second axis and a third axis along a direction of length thereof respectively; the partial length components of the first, second and third axis are parallel to a long axis of the arch pad main body, and the plurality of first, second and third engagement members are positioned adjacent to two ends of the first, second and third axis respectively.

In a preferred embodiment, wherein a direction of length of each plurality of first, second and third engagement extension forms an acute angle with or is parallel to the first, second and third axis respectively.

In a preferred embodiment, wherein the arch pad main body has at least one of the first, second and third engaging holes. The engaging hole is a through hole from the top surface through the bottom surface of the arch pad main body, and when the first, second and third engagement members are pressed into the first, second and third engaging holes respectively, the first, second and third engagement extensions are deformed and bent in order to be engaged by the surface opening on top of the engaging hole, and when at least one of the first, second and third engagement extensions are further pressed into the first, second and third engaging holes respectively, at least one of the first, second and third engagement extensions rebounds to the original position in order to be closely engaged by the opening at the bottom of the engaging hole. In a preferred embodiment, wherein a projection of one of the first engagement extensions, a projection of one of the second engagement extensions and a projection of one of the third engagement extensions projecting onto the arch pad main body is a shape of an ellipse, a polygon or a combination thereof; and a projection of another one of the first engagement extension, a projection of another one of the second engagement extension and a projection of another one of the third engagement extension projecting onto the arch pad main body is a shape of a circle or a polygon. In a preferred embodiment, wherein the first rigid stiffener is configured to be assembled into the arch pad main body, and the second rigid stiffener is engaged with the plurality of second engaging holes or the third rigid stiffener is engaged with the plurality of third engaging holes.

In a preferred embodiment, wherein the second rigid stiffener is configured to be assembled into the arch pad main body, and the third rigid stiffener is engaged with the plurality of third engaging holes.

In a preferred embodiment, wherein the insole with arch pad main body further comprises a heel portion corresponding to a foot heel.

In a preferred embodiment, the first rigid stiffener further comprises a first heel extension portion extends to at least a lateral side of the heel portion along a lateral side of the arch pad main body; the second rigid stiffener further comprises a second heel extension portion extends to at least a medial side and the lateral side of the heel portion along a long axis of the arch pad main body; the third rigid stiffener further comprises a third heel extension portion extends to at least the medial side of the heel portion along the medial side of the arch pad main body.

In a preferred embodiment, wherein the heel portion of the arch pad main body includes a receiving recess for receiving at least the first heel extension portion, the second heel extension portion and the third heel extension portion therein.

In a preferred embodiment, the present invention further comprises a fourth rigid stiffener having a structure identical to a structure of the first rigid stiffener according to the content of page. 3, line 5 to page. 4, line 6 of this specification, a fifth rigid stiffener having a structure identical to a structure of the second rigid stiffener according to the content of page. 3, line 5 to page. 4, line 6 of this specification, and a sixth rigid stiffener having a structure identical to a structure of the third rigid stiffener according to the content of page. 3, line 5 to page. 4, line 6. In a preferred embodiment, wherein the first rigid stiffener, the second rigid stiffener, the third rigid stiffener, the fourth rigid stiffener, the fifth rigid stiffener and the sixth rigid stiffener are made of any one of a material of a plastic, a glass fiber, a blended carbon fiber or a metal material or a combination thereof.

In a preferred embodiment, wherein the first rigid stiffener is configured to be assembled into the arch pad main body, and the fifth rigid stiffener is engaged with the plurality of second engaging holes.

In a preferred embodiment, wherein the second rigid stiffener is configured to be assembled into the arch pad main body, and the fourth rigid stiffener is engaged with the plurality of first engaging holes or the sixth rigid stiffener is engaged with the plurality of third engaging holes.

In a preferred embodiment, wherein the third rigid stiffener is configured to be assembled into the arch pad main body, and the fifth rigid stiffener is engaged with the plurality of second engaging holes.

In a preferred embodiment, wherein the insole with arch pad main body further comprises at least one forefoot cushion pad in order to distribute the pressure on forefoot or increase shock absorption of the tunable rigidity insole.

In view of the above, the tunable rigidity insole with interchangeable stiffeners of the present invention has at least the following advantages:

(1) Every solution of arch support provides a single arch pad main body with at least three stiffeners; therefore, it requires less material and is able to overcome the problems of the excessive production molds for the manufacturing process and excessive inventory cost.

(2) A lateral longitudinal arch support, a central area arch support and a medial longitudinal arch support are available by selecting different interchangeable stiffeners, thus the insole requires less material; consequently, the material cost can be reduced.

(3) After stiffeners engaged with the arch pad main body, the engagement member is able to maintain close engagement with the arch pad main body without separation during the bending of the arch pad main body by loading the weight thereon.

(4) A strengthened supporting force can be provided easily to the lateral longitudinal arch, the medial longitudinal arch, the central arch area or a combination thereof, such that greater weight bearing can be supported thereon.

The description provided here is for illustrative purpose only and shall not be used to limit to the scope of the present invention. A detailed description of the exemplary embodiments of the present invention will be further illustrated in the following paragraphs.

DETAILED DESCRIPTION OF EMBODIMENTS

The following provides a detailed description of the exemplary embodiments along with the accompanied drawings to facilitate the understanding of the technical features and effects of the present invention.

Figure 1A:
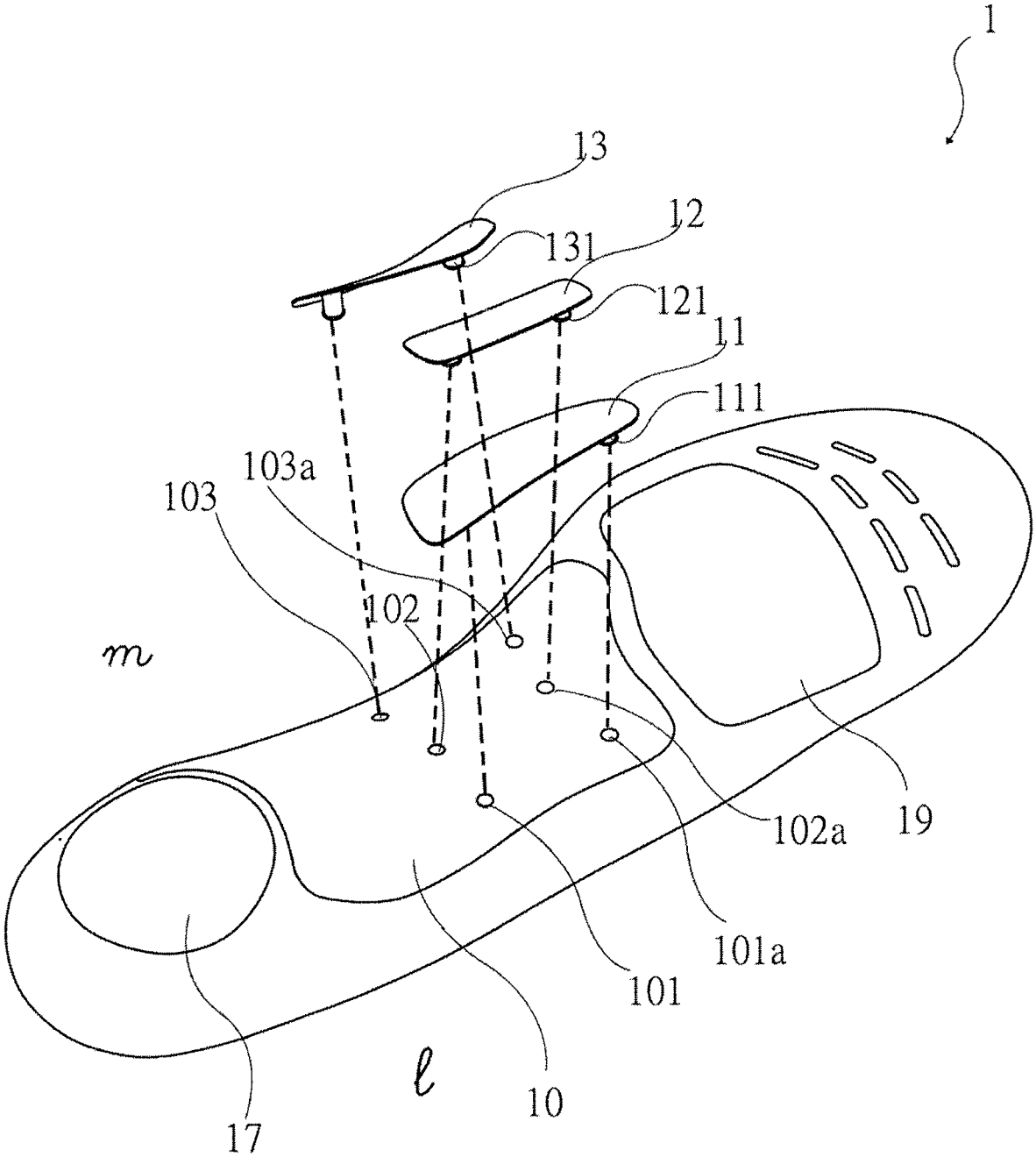
FIG. 1A is a schematic drawing of the tunable rigidity insole with interchangeable stiffeners according to an embodiment of the present invention.
Figure 1B:
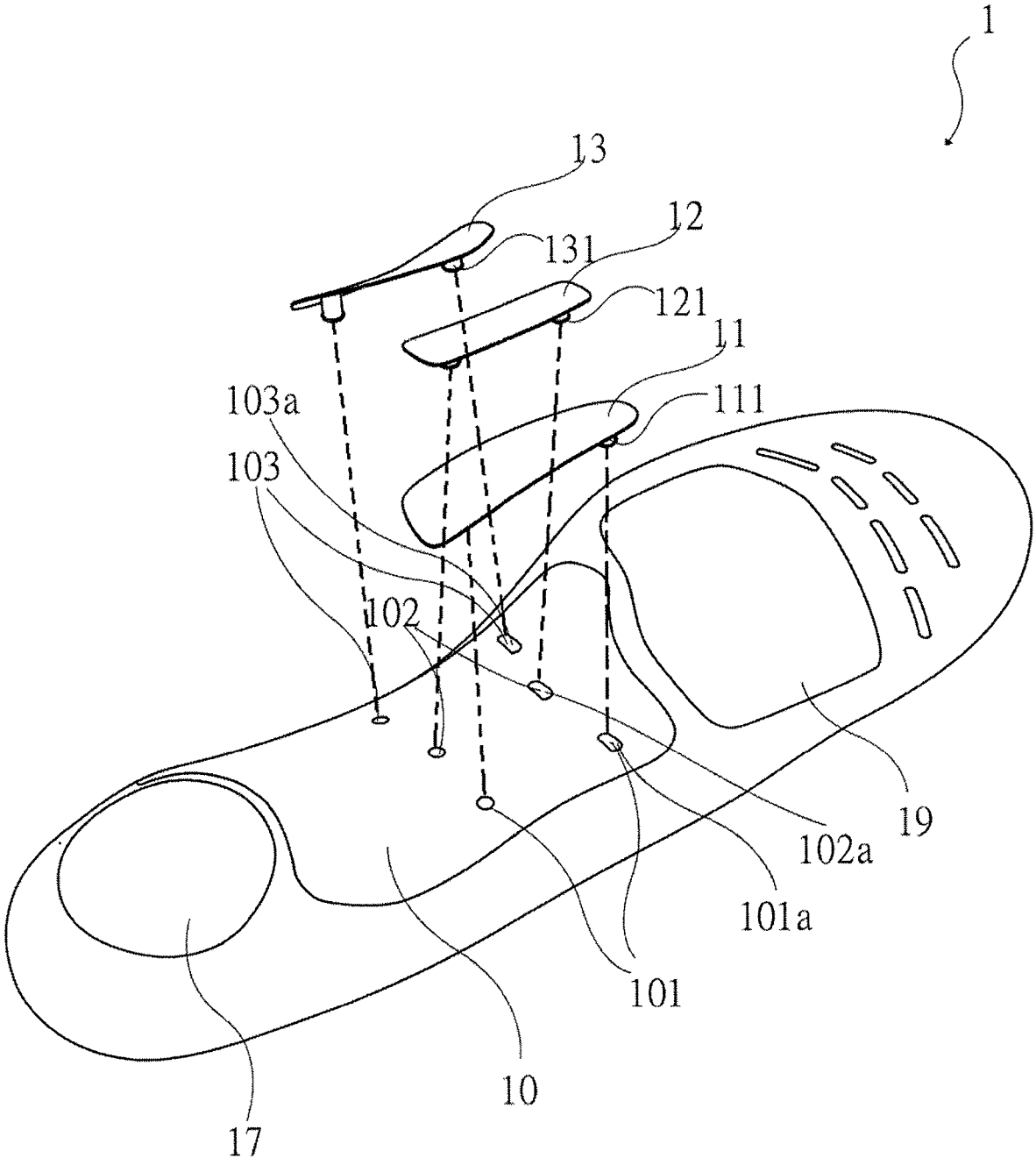
FIG. 1B is a schematic drawing of another aspect of an embodiment of the tunable rigidity insole with interchangeable stiffeners of the present invention.
Figure 2:
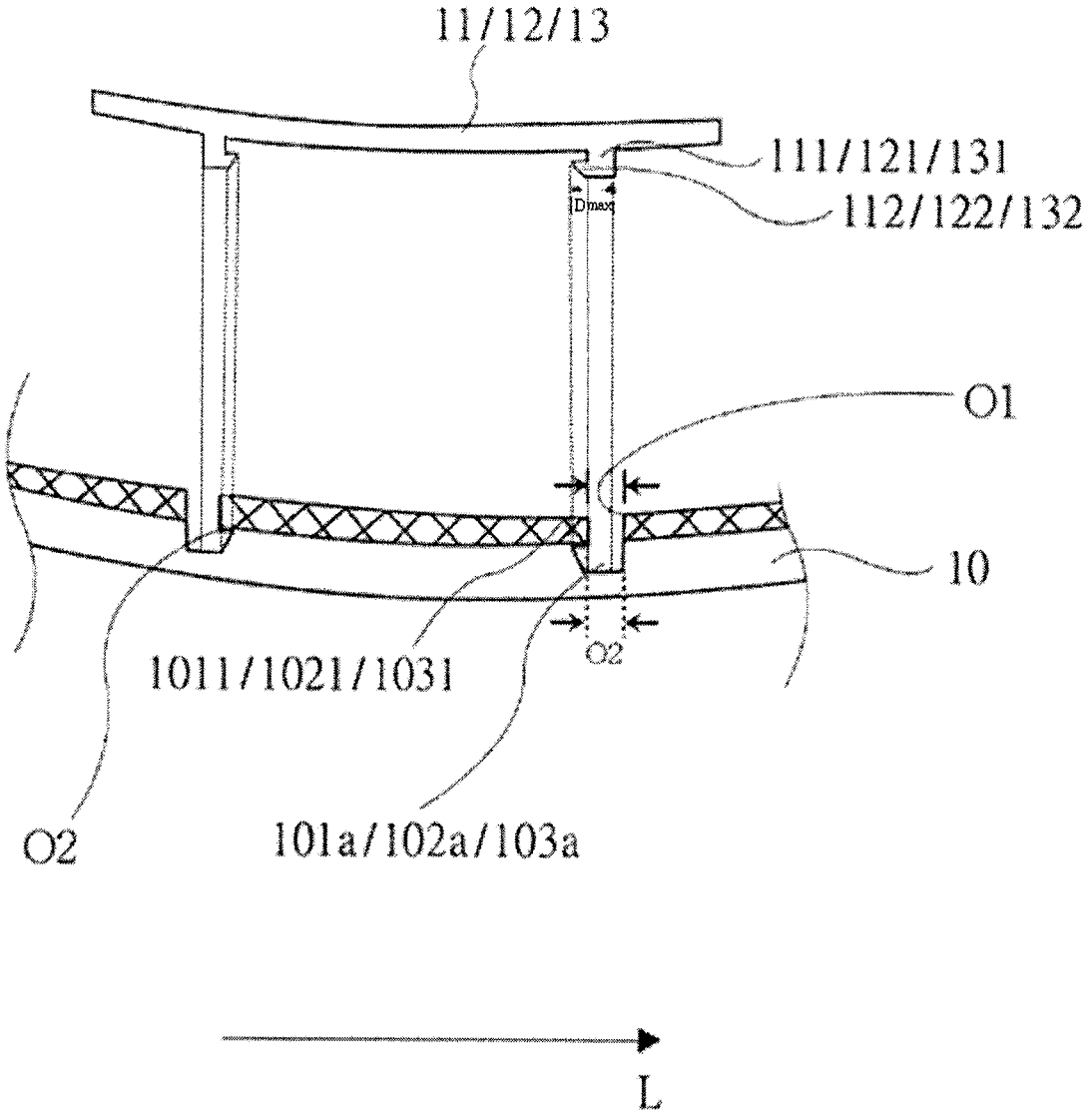
FIG. 2 is a cross sectional view of an engagement mechanism of the tunable rigidity insole with interchangeable stiffeners of the present invention.

As shown in FIG. 1A, it is a schematic drawing of the tunable rigidity insole with interchangeable stiffeners according to an embodiment of the present invention, and FIG. 1B is a schematic drawing of another aspect of the embodiment of the tunable rigidity insole with interchangeable stiffeners of the present invention. It shall be noted that the schematic drawing of the tunable rigidity insole with interchangeable stiffeners is an example of a left foot. The tunable rigidity insole with interchangeable stiffeners of the present invention comprises an arch pad main body 10, a first rigid stiffener 11, a second rigid stiffener 12 and a third rigid stiffener 13, wherein the arch pad main body 10 having three sets of the engaging holes can be assembled into at least one of the first rigid stiffener 11, the second rigid stiffener 12 and the third rigid stiffener 13 respectively. To be specific, a material of the first rigid stiffener 11, the second rigid stiffener 12 and the third rigid stiffener 13 can be any composition materials without limiting to the hardness thereof. For example, the composition material of the first rigid stiffener 11, the second rigid stiffener 12 and the third rigid stiffener 13 can be manufactured by any one of the plastic, the glass fiber, the blended carbon fiber and the metal material etc. or the combination thereof. It shall be noted that the composition material manufactured by any one of the plastic, the glass fiber, the blended carbon fiber and the metal material etc. or the combination thereof can be indicated to be a material combined by any two or more kinds of the foregoing material in the way such as stacking, plane combination, three dimensional combination etc. In addition, a side of the arch pad main body 10 adjacent to a lateral longitudinal arch can be defined as a lateral side l (lateral side) of the arch pad main body 10, and a side of the arch pad main body 10 adjacent to a medial longitudinal arch can defined as a medial side m (medial side) of the arch pad main body 10. Therefore, the present invention provides different solutions of arch support selectively with the single arch pad main body 10 and at least three stiffeners requiring less material in order to prevent excessive use of production molds and inventory cost compared to the prior art of three fixed types of ready-made insoles providing single arch support to fit one of the high, medium or low arch. In addition, the support of the lateral longitudinal arch, the central arch area and the medial longitudinal arch can be chosen with stiffeners made by small amount of materials in the present invention; therefore the present invention can reduce the material cost. Specifically, the arch pad main body 10 can have a plurality of first engaging hole 101, a plurality of second engaging hole 102 and a plurality of third engaging hole 103, and the arch pad main body 10 can include a heel portion 17 corresponding to a heel additionally. After assembling, the foregoing first rigid stiffener 11 can support a lateral longitudinal arch of the sole in order to ease the problem resulted from a Supination and/or high arch, and the second rigid stiffener 12 can support the central arch area of the sole in order to ease the problem resulted from mild Pronation and/or medium arch, furthermore the third rigid stiffener 13 can support the medial longitudinal arch of the sole in order to ease the problem resulted from Over-Pronation and/or low arch or flat-foot. The first rigid stiffener 11 includes at least two first engagement member 111, the second rigid stiffener 12 includes at least two second engagement member 121, the third rigid stiffener 13 includes at least two third engagement member 131, and a shape of the plurality of first engagement member 111, second engagement member 121 and third engagement member 131 can be circle, ellipse, polygon or the combination thereof. In addition, the plurality of first engagement member 111, second engagement member 121 and third engagement member 131 can be bent in order to match the surface contour of the arch pad main body 10. As shown in FIG. 2, at least one first engagement member 111 includes a first engagement extension 112 with at least a part of length component of the first engagement extension 112 toward another one of the first engagement member 111 at an end of the first engagement member 111 away from the first rigid stiffener 11, at least one second engagement member 121 includes a second engagement extension 122 with at least a part of length component of the second engagement extension 122 toward another one of the second engagement member 121 at an end of the second engagement member 121 away from the second rigid stiffener 12, at least one third engagement member 131 includes a third engagement extension 132 with at least a part of length component of the third engagement extension 132 toward another one of the third engagement member 131 at an end of the third engagement member 131 away from the third rigid stiffener 13, and the first, second and/or third stiffener can be engaged with the arch pad main body by the first, second and/or third engagement members corresponding to the first, second and/or third engaging hole respectively. In addition, the insole with arch pad main body 10 can include at least one of the forefoot portion, forefoot cushion pad 19 in particular, corresponding to the front part of sole in order to distribute a forefoot pressure and/or increase shock absorption of the tunable rigidity insole.

In detail, in an example of the first rigid stiffener 11, the first engagement member 111 and the first engagement extension 112, a material hardness of the first engagement extension 112 is not limited, and a shape of one of the first engagement extensions 112 projecting onto the arch pad main body 10 can be circle, ellipse, polygon or the combination thereof. A shape of one of the first engagement extensions 112, one of the second engagement extensions and one of the third engagement extensions projecting onto the arch pad main body is a ellipse, a polygon or the combination thereof, and another one of the first engagement extension, a shape of another one of the second engagement extension and another one of the third engagement extension projecting onto the arch pad main body is a circle or a regular polygon. The first engaging hole 101 can include a flange 1011 adjacent to a surface of the arch pad main body 10, and a length of a surface opening on top of the engaging hole O1 enclosed by the flange 1011 can be less than a length of opening at the bottom of the engaging hole O2 of the first engaging hole 101*a*, in order to closely engaged with the first engagement extension 112 and the first engaging hole 101 without separation. It shall be noted that the second engaging hole 102 and the third engaging hole 103 can also include a flange 1021 and a flange 1031, and the structures thereof are similar to the flange 1011, and repetitive details thereof are omitted hereafter. The first engagement extension 112 includes at least a set of end points with a maximum distance $D_{max}$ between each other at a surface margin of the arch pad main body 10, and the engagement extension with maximum distance $D_{max}$ can be approximately parallel to the surface margin of the arch pad main body 10. The line connected to the two end points is a length of the first engagement extension 112, and the first engagement member 111 includes a first engagement extension 112 having at least a partial length component toward another one of the first engagement extension 112 at an end portion of the first engagement member 111 in order to maintain the tight engagement between the first engagement member 111 and arch pad main body 10 without separation while the arch pad main body 10 is bent. It shall also be noted that a structure of the second engagement extension 122 and the third engagement extension 132 are similar to the structure of the first engagement extension 112, and repetitive details thereof are omitted hereafter.

As shown in FIG. 1A, a shape of the surface opening on top of the engaging hole O1 of each engaging hole projecting onto the arch pad main body 10 can be circle. However, the shape of the surface opening on top of the engaging hole O1 of each engaging hole projecting onto the arch pad main body 10 can be a shape with a direction of length being approximately parallel to a long axis L of the arch pad main body 10, for example the shape of the surface opening on top of the engaging hole O1 of each engaging hole can be circle, ellipse, polygon or the combination thereof. In addition, a shape of the first engagement extension 112 pointing an end portion of the flanges 1011/1021/1031 can be a smooth arc or a smooth slope in order to facilitate each of the engagement extensions 112/122/132 to be pressed into each of the engaging holes 101(101*a*)/102(102*a*)/103(103*a*) correspondingly.

Figure 2A:
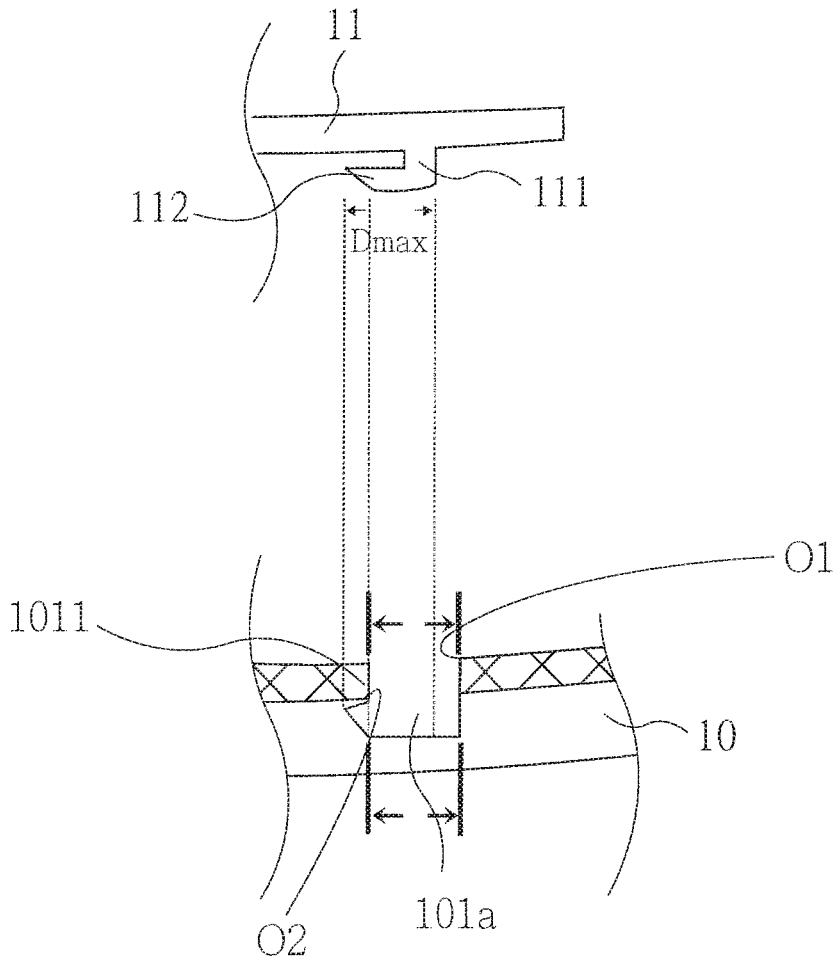
FIG. 2A is a cross sectional view of the present invention showing the details process of engagement between the stiffener and the arch pad main body.
Figure 2B:
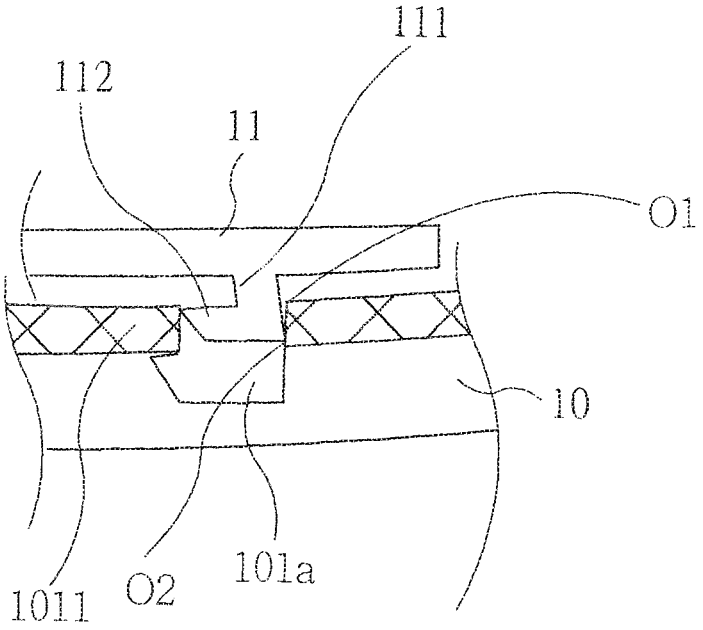
FIG. 2B is another cross sectional view of the present invention showing how the stiffener engages into the arch pad main body.
Figure 2C:
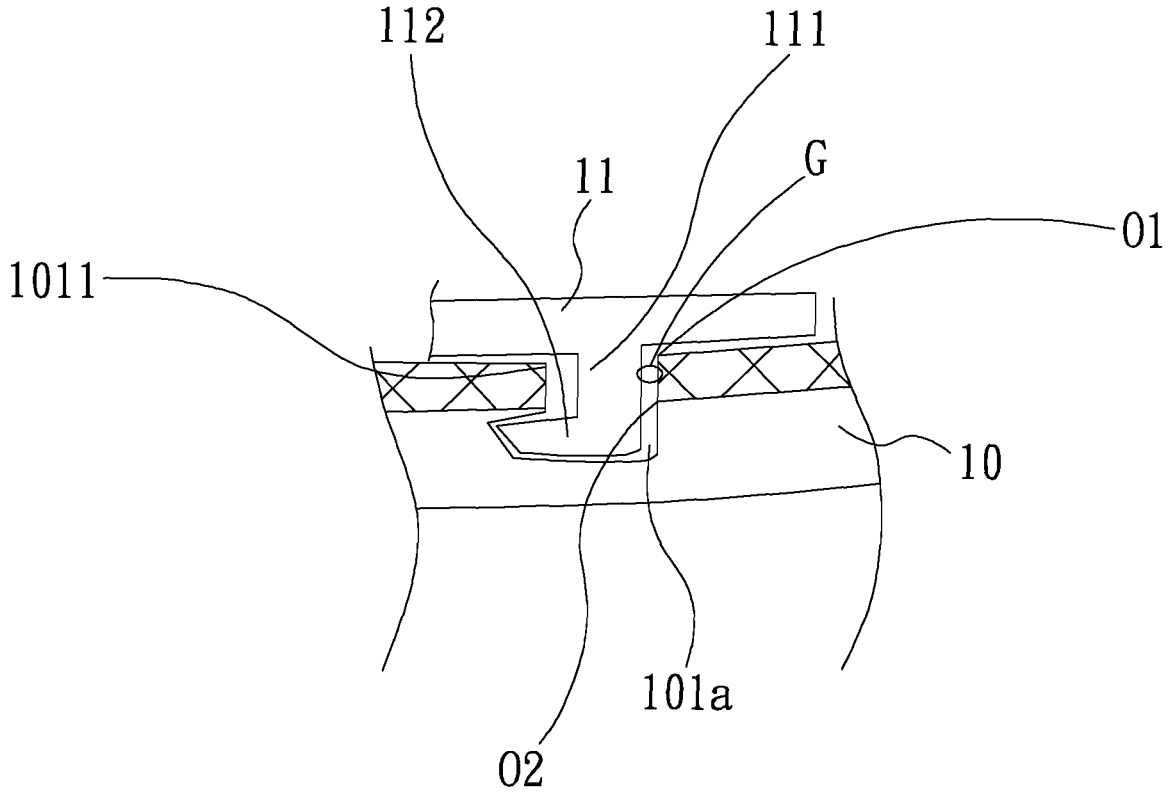
FIG. 2C is still another cross sectional view of the present invention showing the details of engagement between the stiffener and the arch pad main body.

As shown in FIG. 2A to FIG. 2C, they are the section views of a series of engagement process of another embodiment of the engagement between the stiffener and the arch pad main body. As shown in FIG. 2A and in an example of the engagement between the first engagement member 111 and the first engaging hole 101*a*, the length of the surface opening on top of the engaging hole O1 can be designed to be a length equal to or a slightly longer than the maximum distance $D_{max}$ in the present embodiment. In addition, a gap G can be provided between a back wall of the first engagement member 111 and a back wall of the first engaging hole 101*a*, and a position of the first engaging hole 101*a* is corresponding to the back wall of the first engagement member 111.

In the following, as shown in FIG. 2B, the first engagement member 111 is pressed into the first engaging hole 101*a* by force. The first engagement extension 112 is then displaced slightly in order to be engaged into the surface opening on top of the engaging hole O1 due to the shape of the end portion of the first engagement extension 112 is the smooth arc or the smooth slope, and a rod portion of the first engagement member 111 is then deformed and bent slightly, therefore the first engagement extension 112 can be engaged by the surface opening on top of the engaging hole O1 completely.

As shown in FIG. 2C, after the first engagement member 111 is pressed into the first engaging hole 101*a* subsequently, the first engagement extension 112 rebounds to the original position in order to be engaged by the opening at the bottom of the engaging hole O2, and the rod portion of the first engagement member 111 is restored back to the position before engaging. Meanwhile, the tight engagement between the first engagement member 111 and the arch pad main body 10 is still maintained without separation when the arch pad main body 10 is bent. It shall be noted that the length of the opening at the bottom of the engaging hole O2 can be designed to be a length equal to or a slightly longer than the maximum length of the surface opening on top of the engaging hole O1 in the present embodiment.

It shall be noted that if a soft material for example the soft PU foam and/or EVA etc. is used for the layer corresponding to an opening at the bottom of the engaging hole O2 formed later, the opening at the bottom of the engaging hole O2 may not be provided before the first engagement member 111 is pressed into the layer, and the opening at the bottom of the engaging hole O2 may be formed by the force when pressing the first engagement member 111 into the layer. Furthermore, the embodiments of the pre-fabricated provided opening at the bottom of the engaging hole O2 and the bottom of the engaging hole O2 formed after the first engagement member 111 is pressed into the layer may be used at the same time.

Figure 3A:
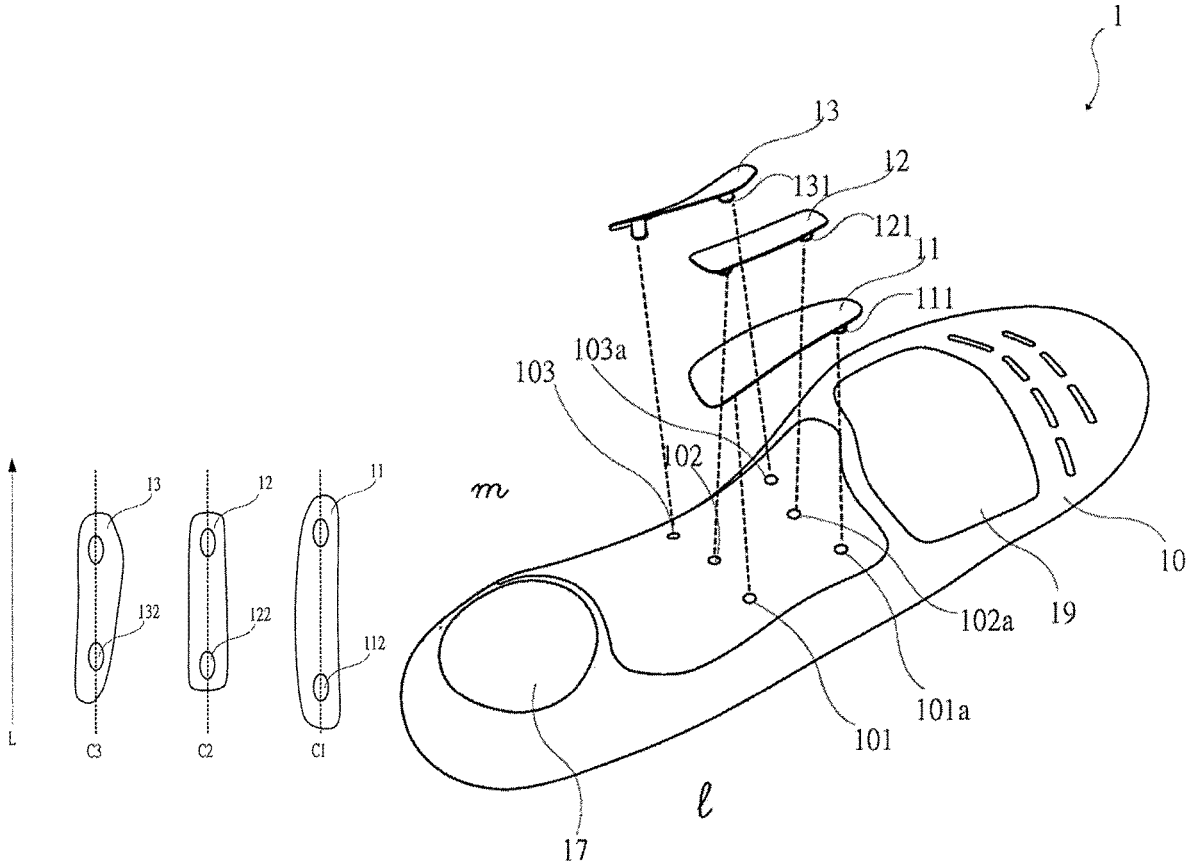
FIG. 3A is a top view of the respective engagement extensions of the tunable rigidity insole with interchangeable stiffeners of the present invention.

In addition, a bottom layer may be provided under the layer (soft material), and the bottom layer may be contacted with the bottom surface of the first engagement member 111 particularly. For example, the bottom layer may be a single hard layer, a multilayer made by at least one hard layer and at least one soft layer etc. As shown in FIG. 3A and FIG. 3C, the first rigid stiffener 11, the second rigid stiffener 12 and the third rigid stiffener 13 includes a first axis C1, a second axis C2 and a third axis C3 disposed along a direction of length thereof respectively, and a part of the length component of the first, the second and the third axis can be parallel to the long axis L of the arch pad main body 10, e.g. the first, the second and the third axis are approximately parallel to the long axis L. In addition, the plurality of first, second and third engagement member are approximately positioned adjacent to the two ends of the first, the second and the third axis respectively, and the direction along the length of the plurality of first, second and third engagement extension can intersected with acute angle or parallel to the first, second and third axis, respectively.

Figure 3B:
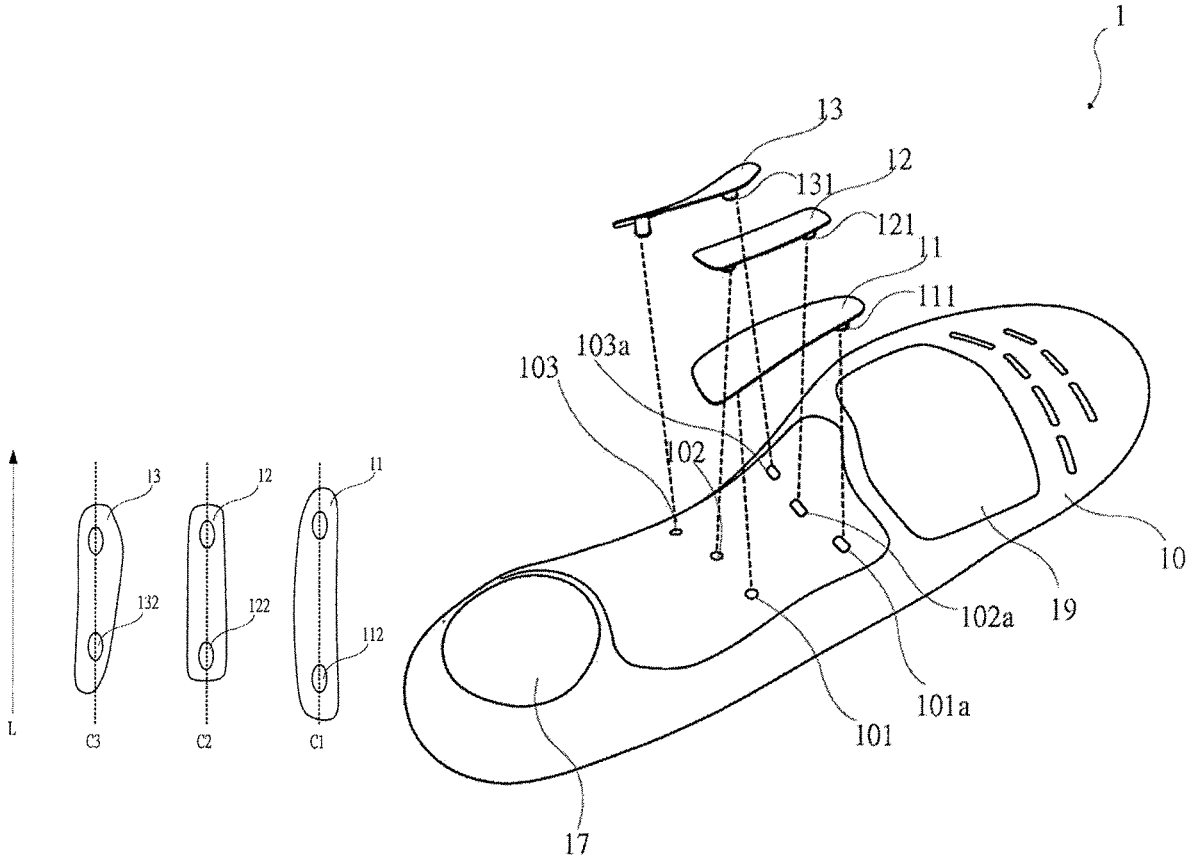
FIG. 3B is a top view of another aspect of respective engagement extensions of the tunable rigidity insole with interchangeable stiffeners of the present invention.
Figure 3C:
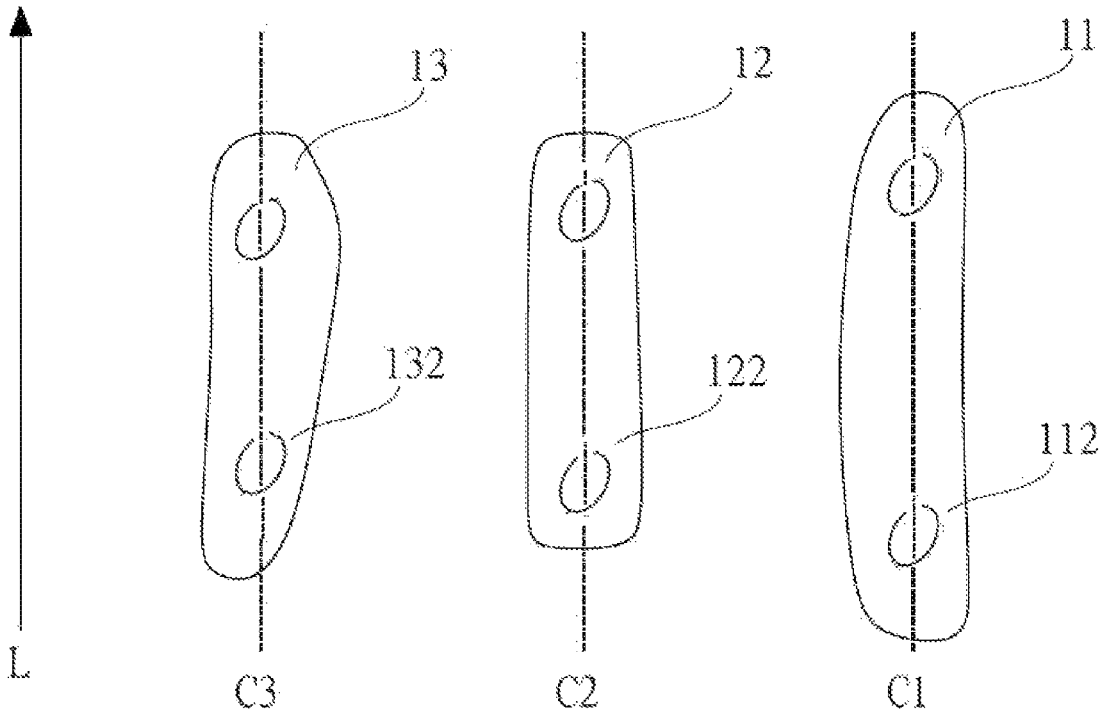
FIG. 3C is a top view of the other aspect of the respective engagement extensions of the tunable rigidity insole with interchangeable stiffeners of the present invention.
Figure 3D:
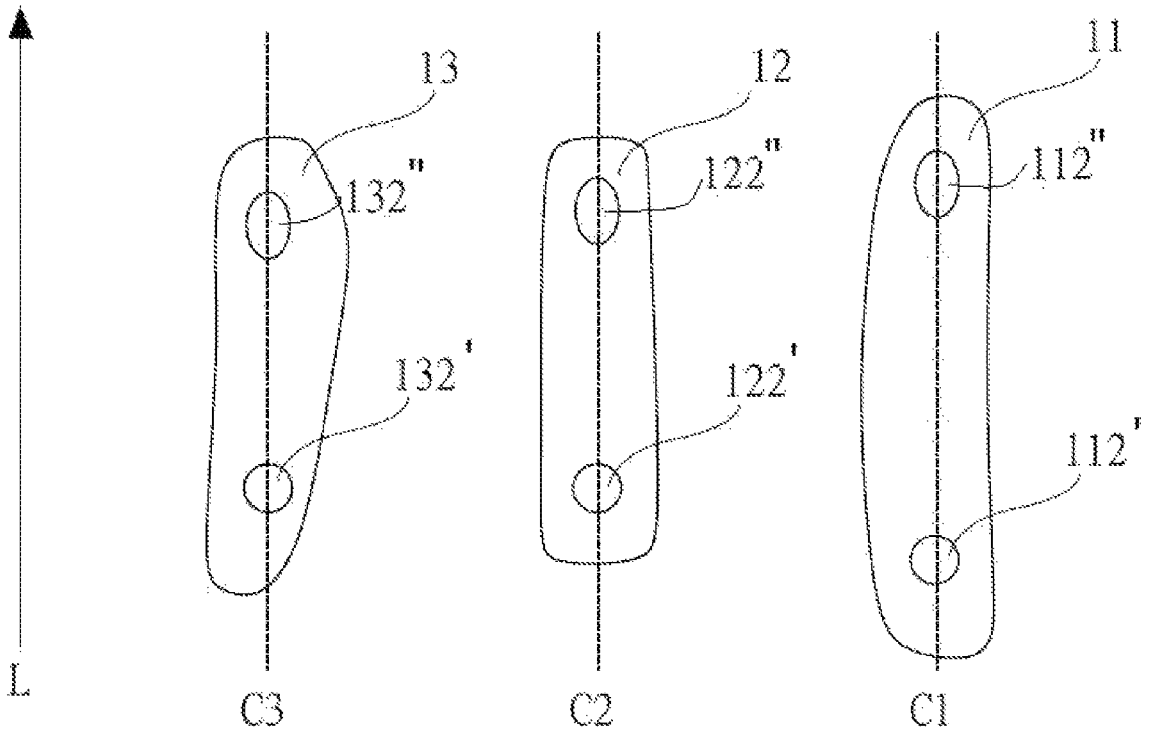
FIG. 3D is a top view of another aspect of respective engagement extensions projecting onto the arch pad main body of the tunable rigidity insole with interchangeable stiffeners of the present invention.

As shown in FIG. 1B, it is a schematic drawing of another aspect of the embodiment of the tunable rigidity insole with interchangeable stiffeners of the present invention, and as shown in FIG. 3B, it is a top view of another aspect of respective engagement extensions of the tunable rigidity insole with interchangeable stiffeners of the present invention. However the aspects in FIG. 1B and FIG. 3B can be embodied in the combination thereof. First, the shape of the surface opening on top of the engaging hole O1 of a first engaging hole 101*a*, a second engaging hole 102*a* and a third engaging hole 103*a* adjacent to a forefoot cushion pad 19 can be an ellipse shape, a polygon shape or a combination thereof with a longer direction projecting onto the arch pad main body 10, and the longer direction can be approximately perpendicular to the long axis L. The shape of the surface opening on top of the engaging hole O1 of the first engaging hole 101, the second engaging hole 102 and the third engaging hole 103 adjacent to a heel portion 17 can be circle or a regular polygon projecting onto the arch pad main body 10. In addition, the shape of one first engagement extension 112, one second engagement extension 122 and one third engagement extension 132 can be ellipse, polygon or the combination thereof with a longer direction projecting onto the arch pad main body 10, and the shape of another one first engagement extension 112, another one second engagement extension 122 and another one third engagement extension 132 projecting onto the arch pad main body 10 can be circle or a regular polygon (as shown as 112', 112", 122', 122", 132', 132" in FIG. 3D). Alternatively, when the engagement extensions are pressed into the engaging holes correspondingly, the direction of length of the engagement extension 112/122/132 with a longer length direction, for example ellipse, polygon or the combination thereof, can be pressed into the first engaging hole 101*a*, the second engaging hole 102*a* or the third engaging hole 103*a* adjacent to the forefoot cushion pad 19 after the direction of length of the engagement extension 112/122/132 are assembled perpendicular to the long axis L. Then, the first axis C1, the second axis C2 and/or the third axis C3 can be changed to a direction approximately parallel to the long axis L. Finally the first engagement extension 112, the second engagement extension 122 and/or the third engagement extension 132 is pressed into the engaging hole 101/102/103 adjacent to the heel portion 17 correspondingly, and the shape of the first engagement extension 112, the second engagement extension 122 and /or the third engagement extension 132 is circle or a regular polygon.

Figure 4:
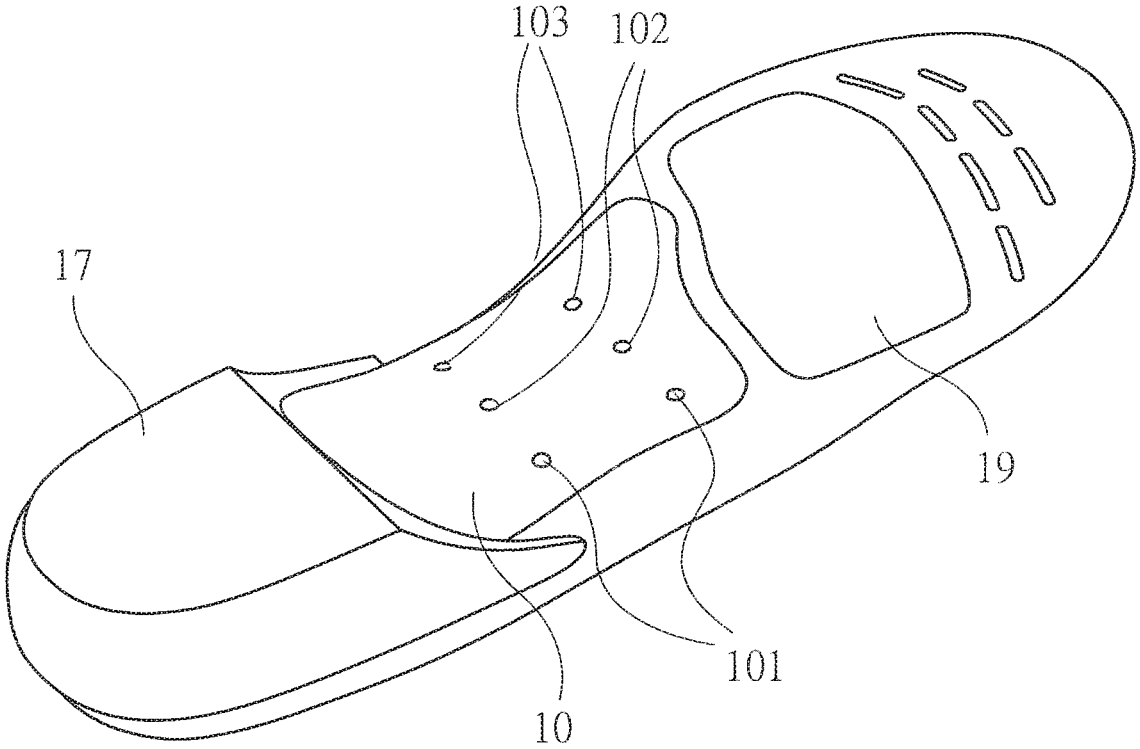
FIG. 4 is a schematic drawing of an aspect of a heel portion of the tunable rigidity insole with interchangeable stiffeners of the present invention.

As shown in FIG. 1 and FIG. 4, wherein a shape of the heel portion 17 in FIG. 1 can be a hilly shape, and a bottom shape of the heel portion 17 in FIG. 4 can be a flat platform shape, and a shape of the side of the heel portion 17 can be an arc. In addition, according to an exemplary embodiment, the engaging hole and the engagement extension can be the same as ones as shown in FIG. 1A, FIG. 1B, FIG. 2, FIG. 3A and FIG. 3B, and repetitive details thereof are omitted hereafter.

Figure 5:
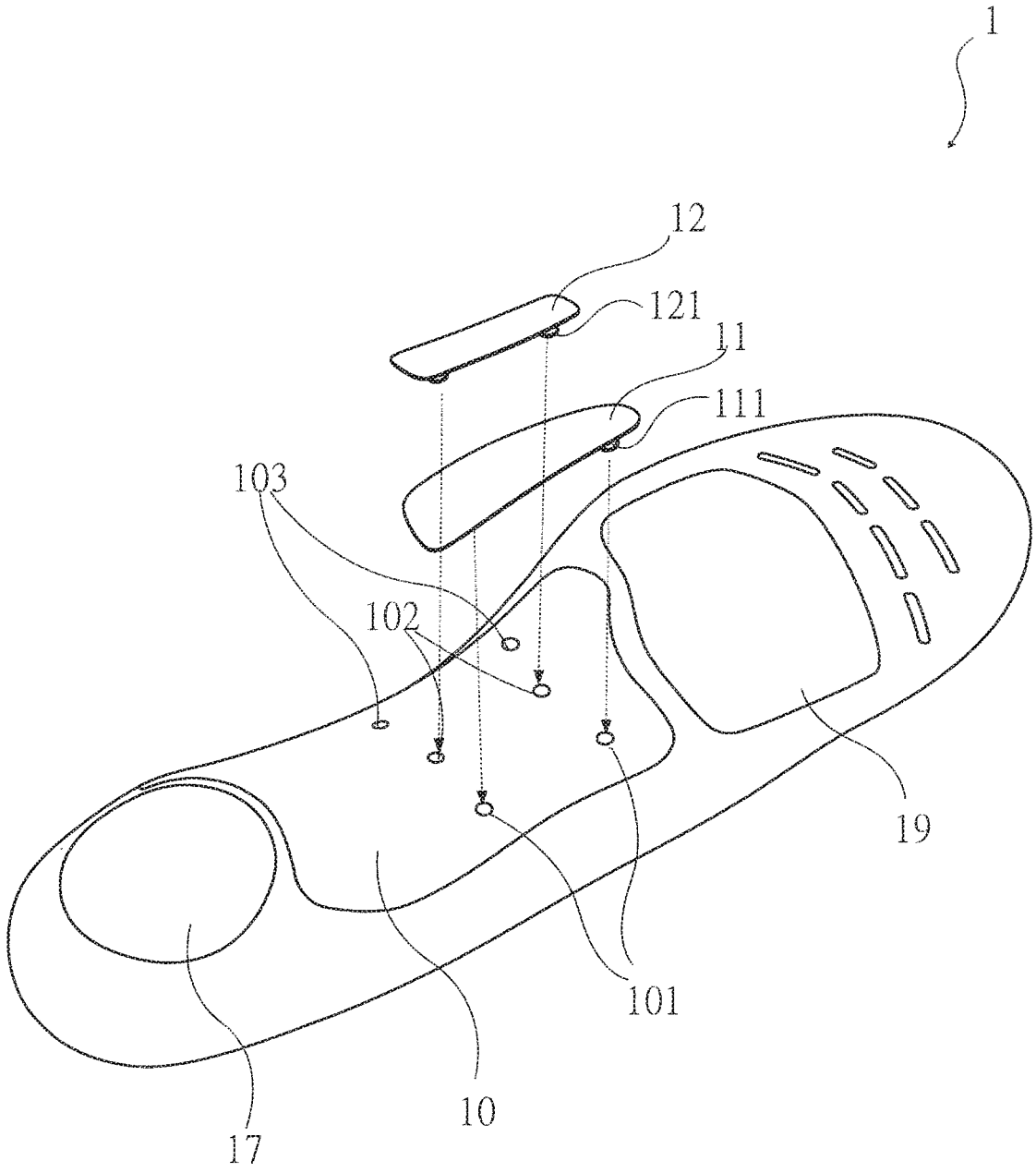
FIG. 5 is a schematic drawing of the first embodiment of the tunable rigidity insole with interchangeable stiffeners having a strengthened supporting force of the present invention.

As shown in FIG. 5, it is a schematic drawing of the first embodiment of the tunable rigidity insole with interchangeable stiffeners with a strengthened supporting force of the present invention. The first rigid stiffener 11 can be assembled into the arch pad main body 10, and the second rigid stiffener 12 can be engaged with the plurality of second engaging hole 102. Therefore, the foot problem of Supination or high arch foot can be overcome, and the present invention is capable of providing stronger supporting force to whom with BMI (body mass index) value higher than 27 overweight or heavily loaded by carrying things, people who participate in high intensity exercise, fast running, cycling etc., in order to support greater weight on the foot sole.

Figure 6:
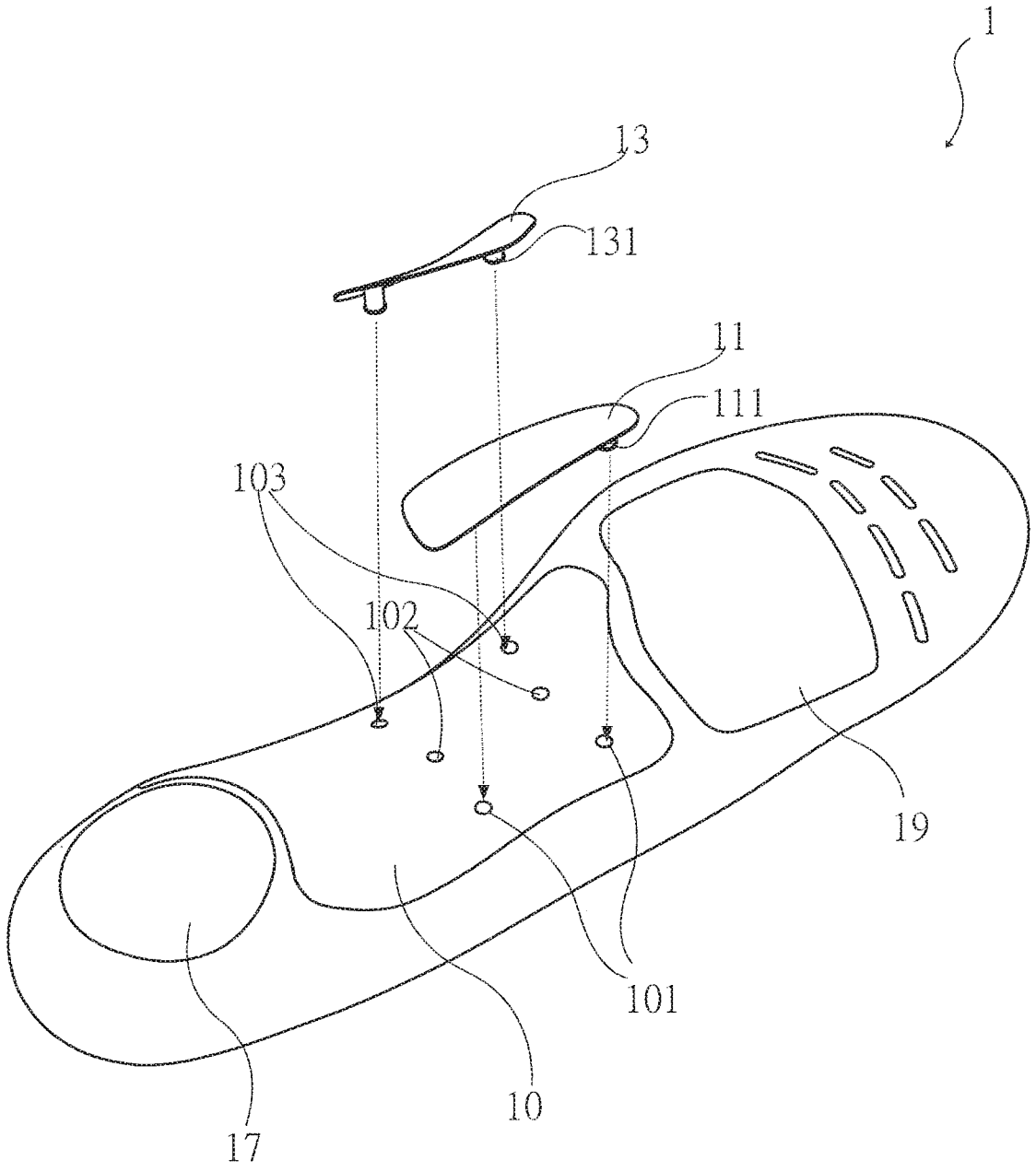
FIG. 6 is a schematic drawing of the second embodiment of the tunable rigidity insole with interchangeable stiffeners having a strengthened supporting force of the present invention.

As shown in FIG. 6, it is a schematic drawing of the second embodiment of the tunable rigidity insole with interchangeable stiffeners with a strengthened supporting force of the present invention. The first rigid stiffener 11 can be assembled into the arch pad main body 10, and the third rigid stiffener 13 can be engaged with the plurality of third engaging hole 103. Therefore, the foot problem of mild Pronation or medium arch foot can be overcome, and the present invention is capable of providing a strengthened supporting force to whom with BMI (body mass index) value higher than 27, overweight or heavily loaded by carrying things, people who participate in high intensity exercise, fast running, cycling etc., in order to support greater weight on the foot sole.

Figure 7:
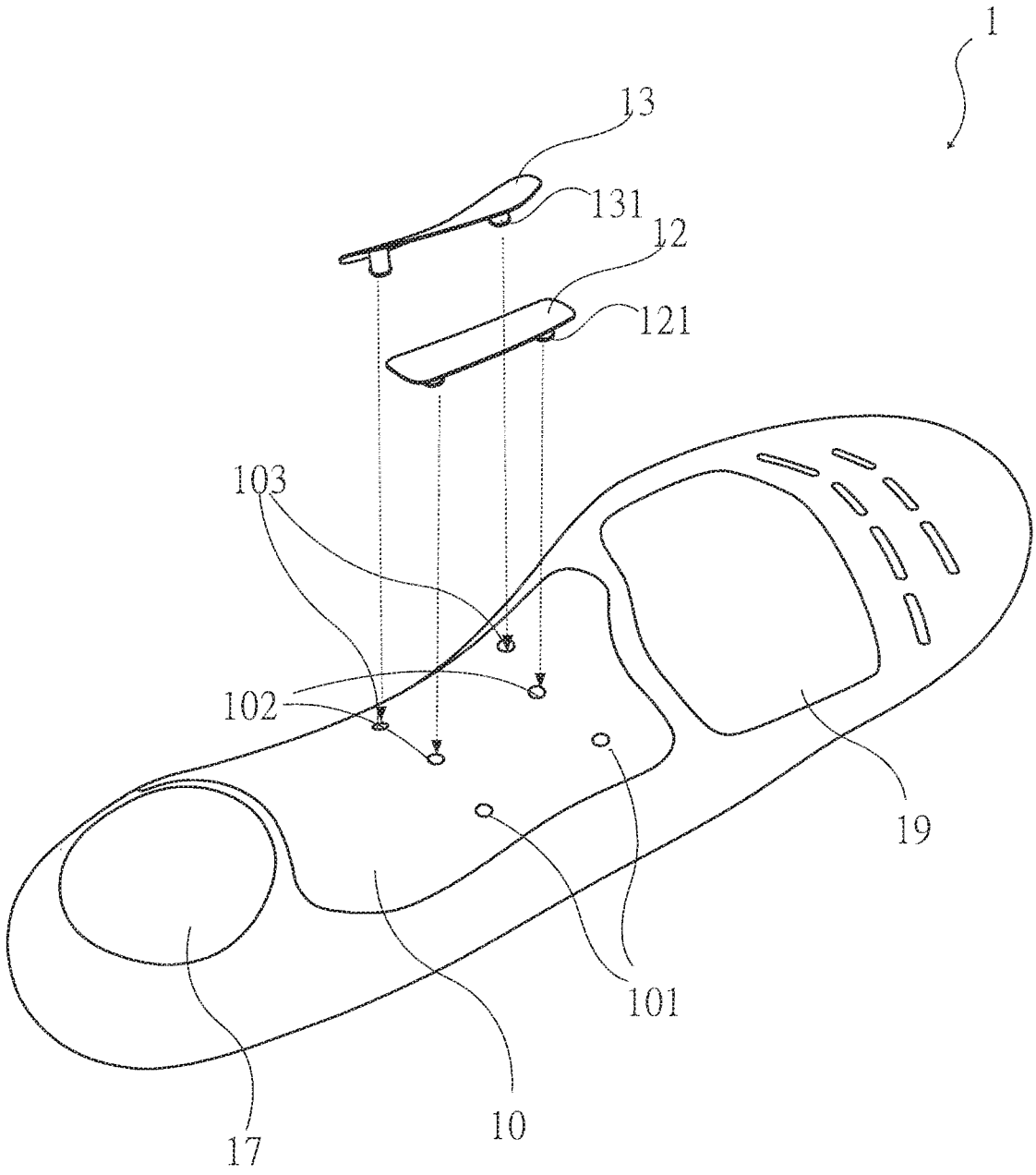
FIG. 7 is a schematic drawing of the third embodiment of the tunable rigidity insole with interchangeable stiffeners having a strengthened supporting force of the present invention.
Figure 8:
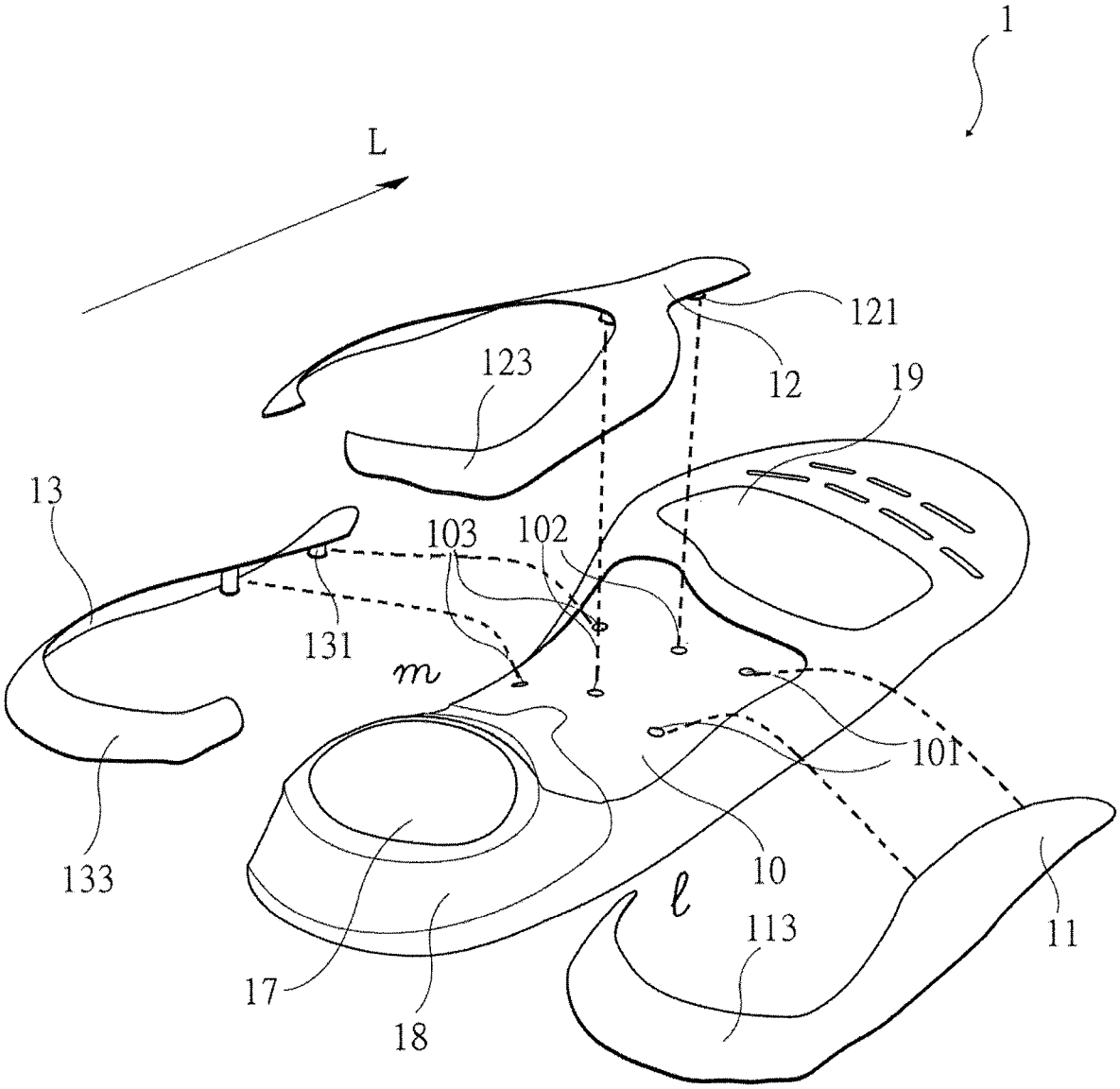
FIG. 8 is a schematic drawing of another aspect of an embodiment of the tunable rigidity insole with interchangeable stiffeners having a strengthened supporting force and different heel support of the present invention.

As shown in FIG. 7, it is a schematic drawing of the third embodiment of the tunable rigidity insole with interchangeable stiffeners with a strengthened supporting force of the present invention. The second rigid stiffener 12 can be assembled into the arch pad main body 10, and the third rigid stiffener 13 can be engaged with the plurality of third engaging hole 103. Therefore, the foot problem of Over-Pronation and/or flat-foot can be overcome, and the present invention is capable of providing a strengthened supporting force to whom with BMI (body mass index) value higher than 27, overweight or heavily loaded by carrying things, people who participate in high intensity exercise, fast running, cycling etc., in order to support greater weight on the foot sole. As shown in FIG. 8, the first rigid stiffener 11 can comprise a first heel extension portion 113 at least extending to a lateral side of the heel portion 17 along a lateral side of the arch pad main body 10, the second rigid stiffener 12 can comprise a second heel extension portion 123 at least extending to a medial side and the lateral side of the heel portion 17 along a long axis L of the arch pad main body 10, the third rigid stiffener 13 can comprise a third heel extension portion 133 at least extending to the medial side of the heel portion 17 along the medial side of the arch pad main body m in order to provide an additional medial side supporting to the heel. For example, the Heel Varus resulted from a high arch foot can be compensated by the first heel extension portion 113, or the Heel Valgus resulted from a flat-foot can be compensated by the third heel extension portion 133. Furthermore the Heel Varus and the Heel Valgus can be prevented by the second heel extension portion 123. In addition, the heel portion 17 of the arch pad main body 10 can include receiving recess 18 at least receiving the first heel extension portion 113, the second heel extension portion 123 and the third heel extension portion 133.

As shown in FIG. 9 to FIG. 12, they are schematic drawings of every embodiments of the present invention including the first heel extension portion 113, the first heel extension portion 113 of the first rigid stiffener 11, the second heel extension portion 123 of the second rigid stiffener 12 and the third heel extension portion 133 of the third rigid stiffener 13 respectively combined with a fourth rigid stiffener 14, a fifth rigid stiffener 15 or a sixth rigid stiffener 16. The plurality of embodiments is capable of easing the foot problem resulted from Supination, pronation or Over-Pronation, and the plurality of embodiments is capable of providing a greater strengthened supporting force to whom with BMI (body mass index) value higher than 27, overweight or heavily loaded by carrying things, people who participate in high intensity exercise, fast running, cycling etc., in order to support greater weight on the foot sole.

In addition, the present invention is capable of compensating the Heel Varus resulted from the high arch foot or compensating the Heel Valgus resulted from the flat-foot, or compensating the Heel Varus and the Heel Valgus.

In addition, the structures of fourth to sixth stiffeners are the same as the structures of first to third stiffeners respectively. However the structures of fourth to sixth stiffeners do not include the first to third heel extension portions.

Figure 9:
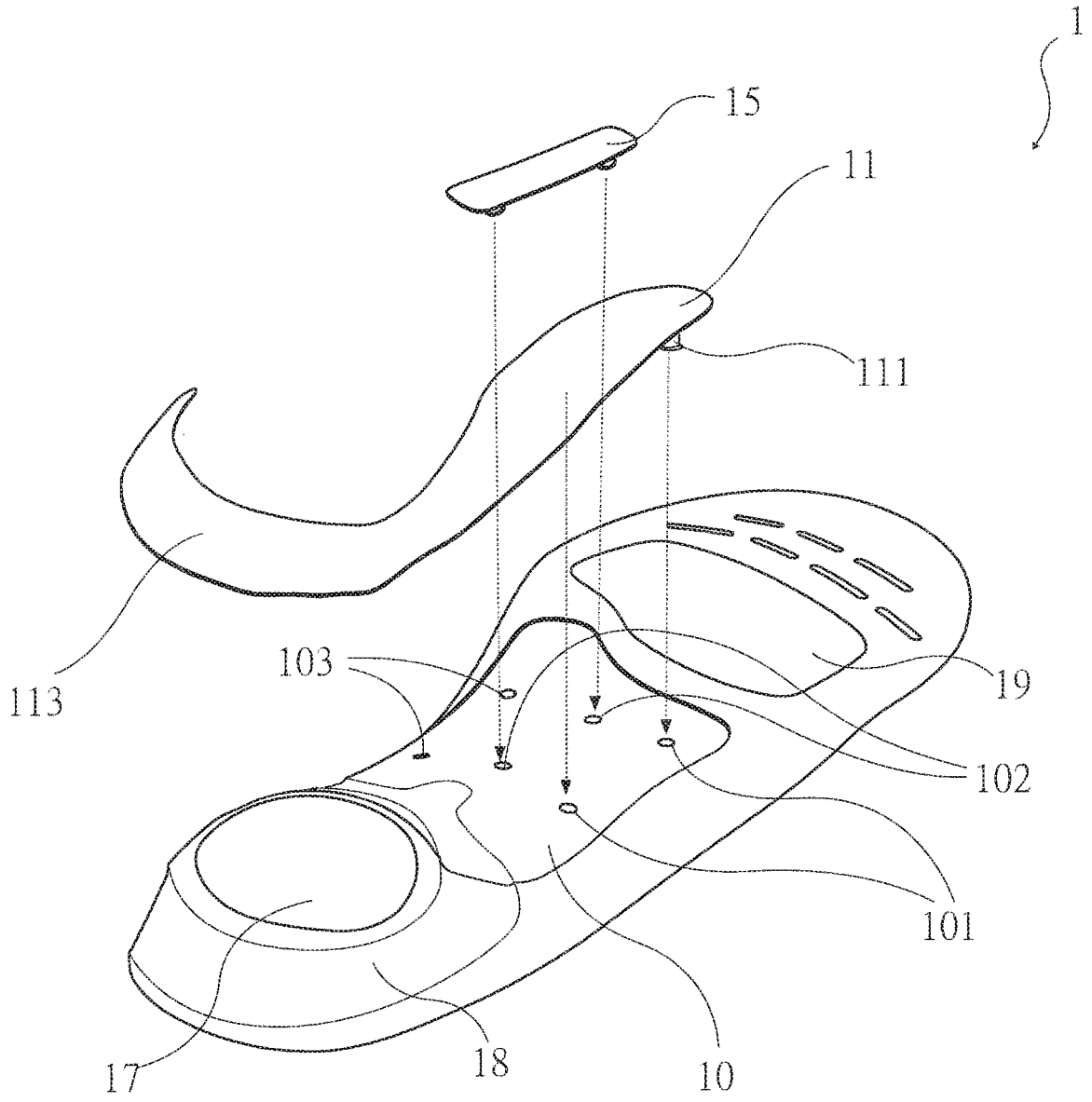
FIG. 9 is a schematic drawing of the fourth embodiment of the tunable rigidity insole with interchangeable stiffeners having a strengthened supporting force of the present invention.
Figure 10:
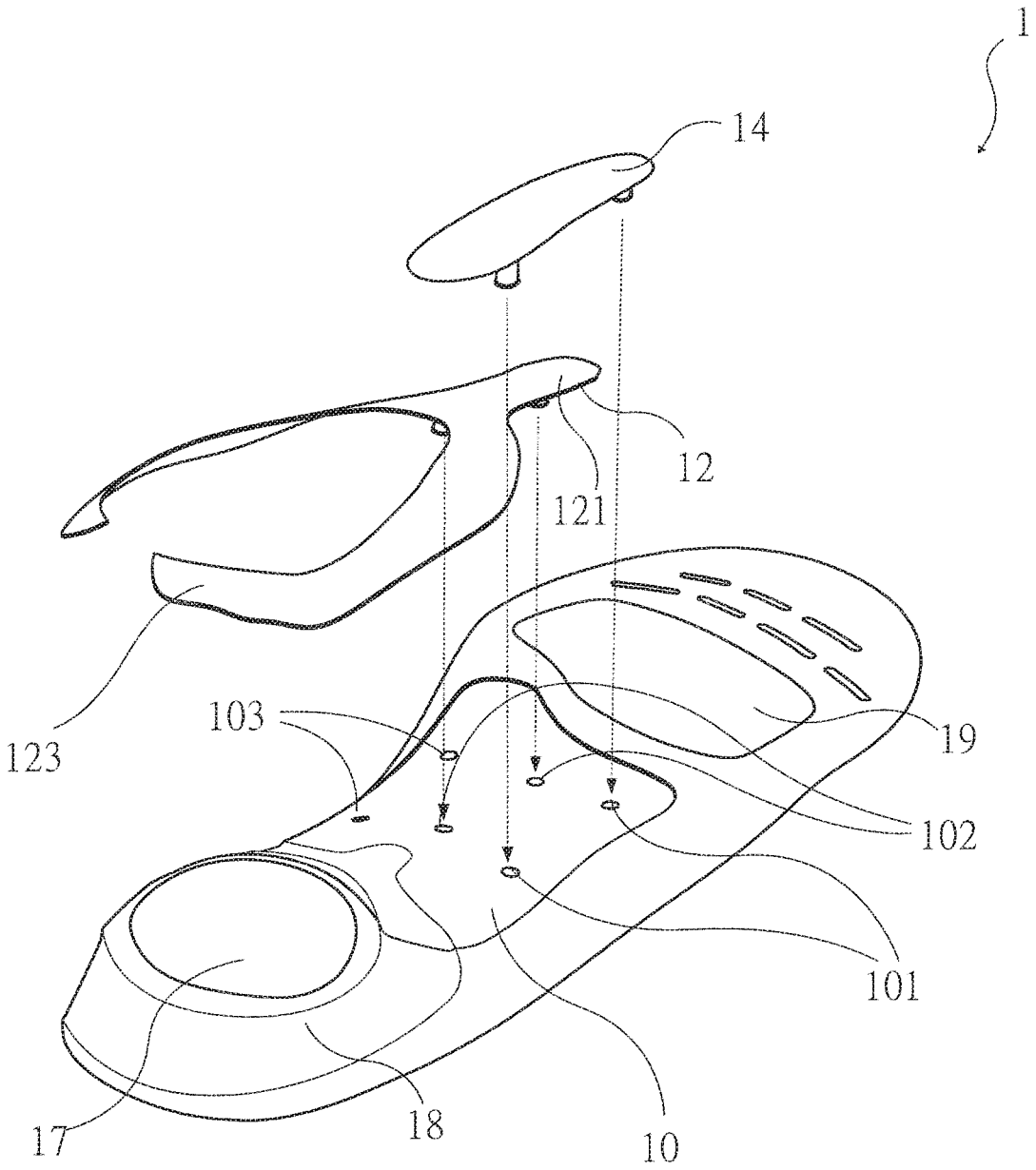
FIG. 10 is a schematic drawing of the fifth embodiment of the tunable rigidity insole with interchangeable stiffeners having a strengthened supporting force of the present invention.

As shown in FIG. 9, when the first rigid stiffener 11 is assembled into the arch pad main body 10, the fifth rigid stiffener 15 can be engaged with the plurality of second engaging hole 102 in order to ease the problem of Supination or high arch foot, and the engaging is capable of compensating the Heel Varus resulted from the high arch foot. In addition, the engaging is capable of providing a greater strengthened supporting force to whom with BMI (body mass index) value higher than 27, overweight or heavily loaded by carrying things, people who participate in high intensity exercise, fast running, cycling etc., in order to support greater weight on the foot sole. As shown in FIG. 10, when the second rigid stiffener 12 is assembled into the arch pad main body 10, the fourth rigid stiffener 14 can be engaged with the plurality of first engaging hole 101 in order to ease the problem of mild Supination or mild high arch foot and to prevent the problem of Heel Varus and Heel Valgus. In addition, the engaging is capable of providing a greater strengthened supporting force to whom with BMI (body mass index) value higher than 27, overweight or heavily loaded by carrying things, people who participate in high intensity exercise, fast running, cycling etc., in order to support greater weight on the foot sole.

Figure 11:
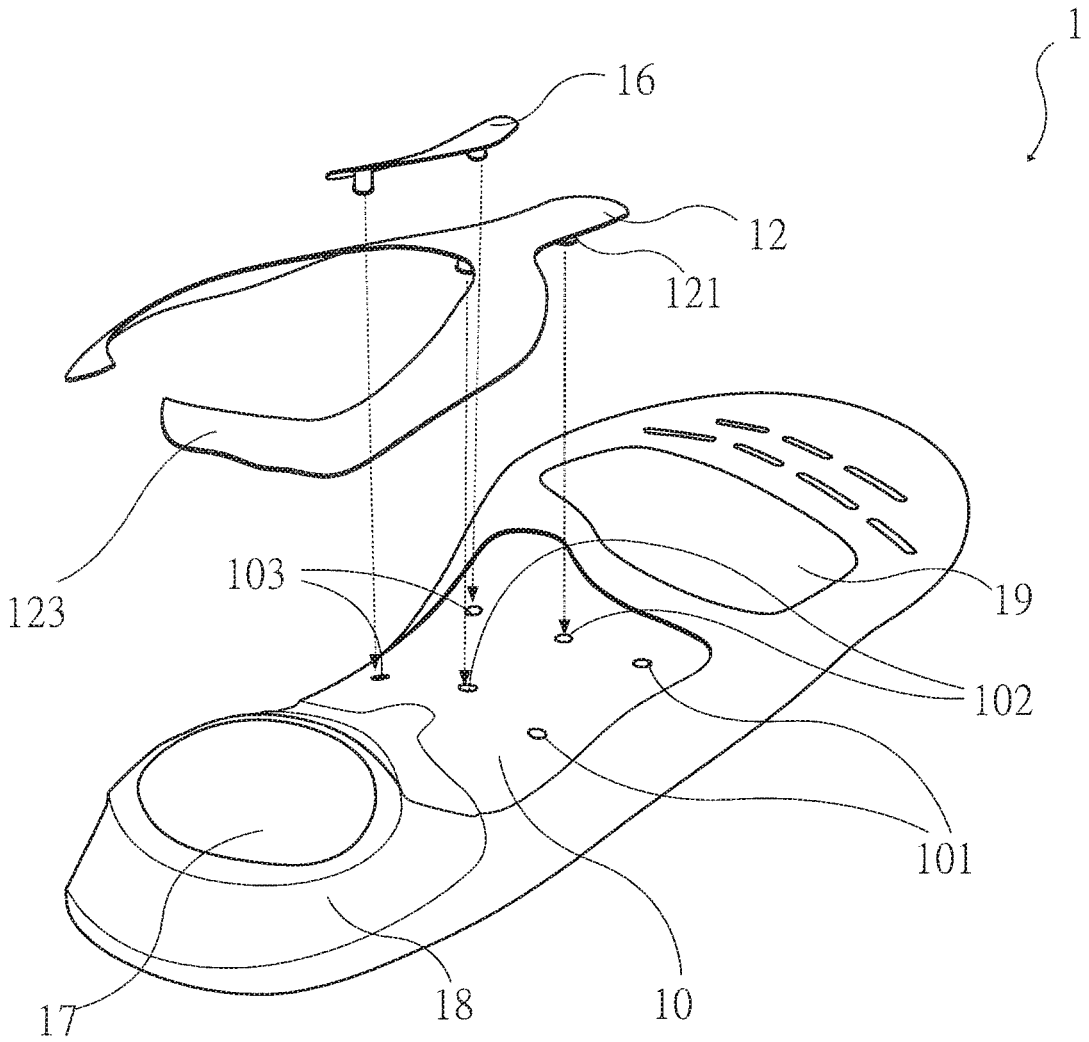
FIG. 11 is a schematic drawing of the sixth embodiment of the tunable rigidity insole with interchangeable stiffeners having a strengthened supporting force of the present invention.

As shown in FIG. 11, when the second rigid stiffener 12 is assembled into the arch pad main body 10, the sixth rigid stiffener 16 can be engaged with the plurality of third engaging hole 103 in order to ease the problem of mild pronation and low arch foot and to compensate Heel Valgus resulted from the low arch foot. In addition, the engaging is capable of providing a greater strengthened supporting force to whom with BMI (body mass index) value higher than 27, overweight or heavily loaded by carrying things, people who participate in high intensity exercise, fast running, cycling etc., in order to support greater weight on the foot sole.

Figure 12:
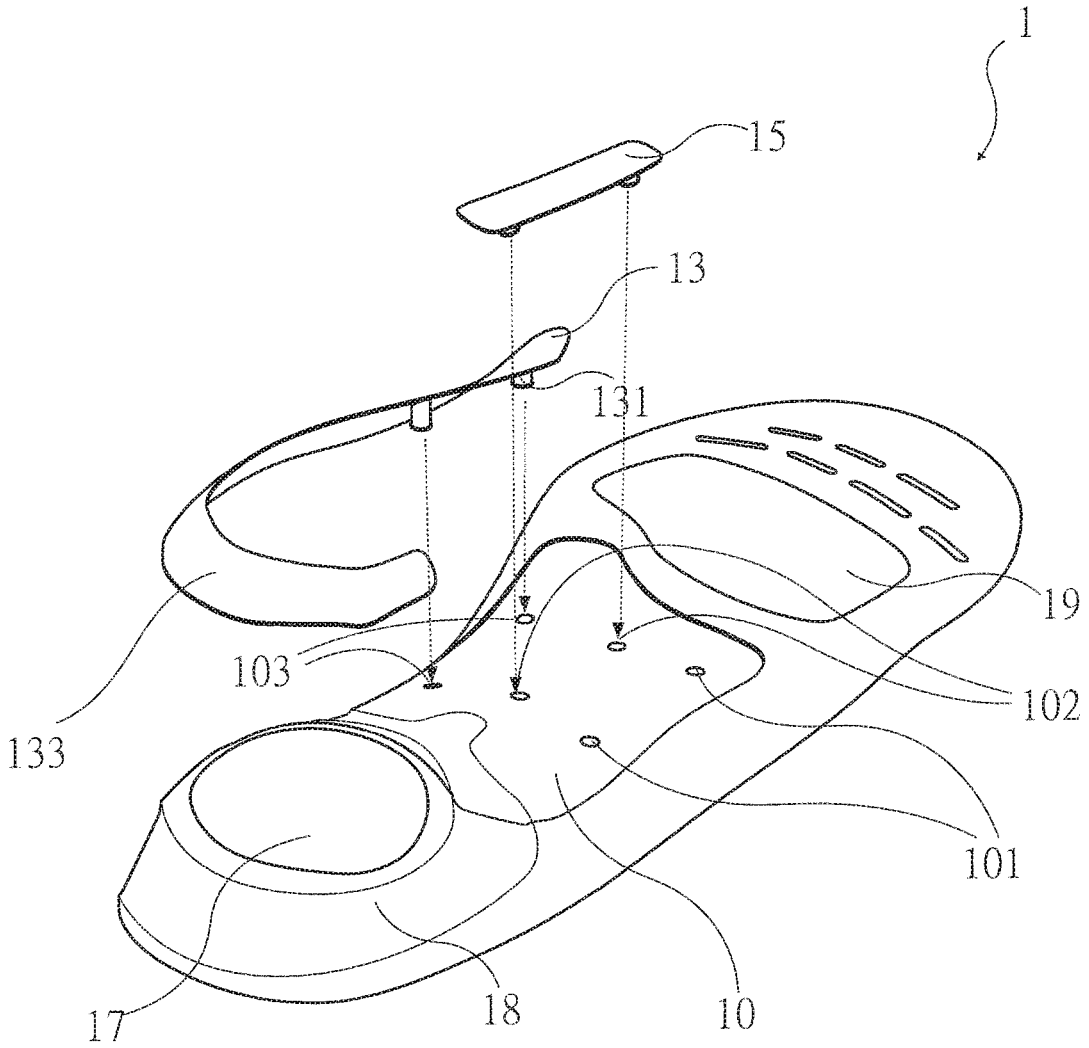
FIG. 12 is a schematic drawing of the seventh embodiment of the tunable rigidity insole with interchangeable stiffeners having a strengthened supporting force of the present invention.

As shown in FIG. 12, when the third rigid stiffener 13 is assembled into the arch pad main body 10, the fifth rigid stiffener 15 can be engaged with the plurality of second engaging hole 102 in order to ease the problem of Over-Pronation and/or flat-foot and to compensate Heel Valgus resulted from the flat-foot. In addition, the engaging is capable of providing a greater strengthened supporting force to whom with BMI (body mass index) value higher than 27, overweight or heavily loaded by carrying things, people who participate in high intensity exercise, fast running, cycling etc., in order to support greater weight on the foot sole.

It shall be noted that the exemplary embodiment of the engaging hole and the engagement extension can be the same as FIG. 1A, FIG. 1B, FIG. 2, FIG. 3A, FIG. 3B, and repetitive details thereof are omitted hereafter.

The above describes the preferred embodiments of the present invention. However, not all of the elements or steps are essential technical features, and all details of the technical features are provided for illustrative purpose only. All units and steps described are provided as examples only, and they can be modified by a person ordinarily skilled in the art of the technical field of this patent application. The scope of the present invention shall be defined by the claims thereof.

SYMBOL DESCRIPTION

1 Tunable rigidity insole with interchangeable stiffeners
10 arch pad main body
101, 101*a* first engaging hole
102, 102*a* second engaging hole
103, 103*a* third engaging hole
1011, 1021, 1031 flange
11 first rigid stiffener
111 first engagement member
112 first engagement extension
113 first heel extension portion
12 second rigid stiffener
121 second engagement member
122 second engagement extension
123 second heel extension portion
13 third rigid stiffener
131 third engagement member
132 third engagement extension
133 third heel extension portion
14 fourth rigid stiffener
15 fifth rigid stiffener
16 sixth rigid stiffener
17 heel portion
18 receiving recess
19 forefoot cushion pad
C1 first axis
C2 second axis
C3 third axis
$D_{max}$ maximum distance
L long axis
O1 surface opening on top of the engaging hole
O2 opening at the bottom of the engaging hole
l lateral side of the arch pad main body
m medial side of the arch pad main body
112', 112", 122', 122", 132', 132" shape of the engagement extensions projecting onto the arch pad main body

What is claimed is:

1. A tunable rigidity insole with interchangeable stiffeners, comprising:

an arch pad main body having a plurality of first engaging holes, a plurality of second engaging holes and a plurality of third engaging holes; and a first rigid stiffener, a second rigid stiffener and a third rigid stiffener; wherein one or two of the first rigid stiffener, the second rigid stiffener and the third rigid stiffener is assembled into a bottom surface of the arch pad main body, and after assembling, the first rigid stiffener supports a lateral longitudinal arch of a sole, the second rigid stiffener supports a central arch area of a sole and the third rigid stiffener supports a medial longitudinal arch of a sole respectively; wherein the first rigid stiffener includes two first engagement members at either end thereof, the second rigid stiffener includes two second engagement members at either end thereof, the third rigid stiffener includes two third engagement members at either end thereof; wherein each of the first, second and third engagement members includes a rod having a back wall, wherein each of the first engagement members includes a first engagement extension extending substantially in a direction away from the back wall of the rod of the first engagement member and toward the first engagement member at the other end of the first rigid stiffener, each of the second engagement members includes a second engagement extension extending substantially in a direction away from the back wall of the rod of the second engagement member and toward the second engagement member at the other end of the second rigid stiffener, each of the third engagement members includes a third engagement extension extending substantially in a direction away from the back wall of the rod of the third engagement member and toward the third engagement member at the other end of the third rigid stiffener; wherein the first, second and third engagement members of the first, second and third rigid stiffeners correspond to the first, second and third engaging holes respectively in order to be engaged with the arch pad main body; wherein one of the first engaging hole, the second engaging hole, and the third engaging hole includes a flange adjacent to a surface of the arch pad main body, and a length of a surface opening on top of the first, second, and third engaging holes enclosed by the flange is less than a length of opening at the bottom of the first, second, and third engaging holes, to thereby be closely engaged with the first, second, and third engagement extensions and the first, second, or third engaging holes without separation;

wherein the rod portion of the first, second, or third engagement members becomes deformed and bent while the first, second, or third engagement extensions are made to enter the surface opening on top of the first, second or third engaging holes, a gap being formed between the back wall of the first, second, or third engagement members and the first, second, or third engaging holes;

wherein the material of the first rigid stiffener, the second rigid stiffener and the third rigid stiffener is at least one selected from the group consisting of glass fiber, blended carbon fiber, a metal material and combinations thereof.

2. The tunable rigidity insole with interchangeable stiffeners according to claim 1, wherein the first rigid stiffener, the second rigid stiffener and the third rigid stiffener include a first axis, a second axis and a third axis along a direction of length thereof respectively; the partial length components of the first, second and third axis are parallel to a long axis of the arch pad main body, and the plurality of first, second and third engagement members are positioned adjacent to two ends of the first, second and third axis respectively.

3. The tunable rigidity insole with interchangeable stiffeners according to claim 2, wherein a direction of length of each of the plurality of first, second and third engagement extensions forms an acute angle with the first, second and third axis respectively or the direction of length of each of the plurality of first, second and third engagement extensions are parallel to the first, second and third axis respectively.

4. The tunable rigidity insole with interchangeable stiffeners according to claim 2, wherein a projection of one of the first engagement extensions, a projection of one of the second engagement extension and a projection of one of the third engagement extension projecting onto the arch pad main body is a shape of an ellipse, a polygon or a combination thereof; and a projection of another one of the first engagement extension, a projection of another one of the second engagement extension and a projection of another one of the third engagement extension projecting onto the arch pad main body is a shape of a circle or a regular polygon.

5. The tunable rigidity insole with interchangeable stiffeners according to claim 1, wherein the first rigid stiffener is configured to be assembled into the arch pad main body, and the second rigid stiffener is engaged with the plurality of second engaging holes or the third rigid stiffener is engaged with the plurality of third engaging holes.

6. The tunable rigidity insole with interchangeable stiffeners according to claim 1, wherein the second rigid stiffener is configured to be assembled into the arch pad main body, and the third rigid stiffener is engaged with the plurality of third engaging holes.

7. The tunable rigidity insole with interchangeable stiffeners according to claim 1, wherein the tunable rigidity insole with interchangeable stiffeners having the arch pad main body further comprises a heel portion corresponding to a foot heel.

8. The tunable rigidity insole with interchangeable stiffeners according to claim 7, the first rigid stiffener further comprises a first heel extension portion extends to a lateral side of the heel portion along a lateral side of the arch pad main body; the second rigid stiffener further comprises a second heel extension portion extends to a medial side and a lateral side of the heel portion along a long axis of the arch pad main body; the third rigid stiffener further comprises a third heel extension portion extends to a medial side of the heel portion along a medial side of the arch pad main body.

9. The tunable rigidity insole with interchangeable stiffeners according to claim 8, wherein the heel portion of the arch pad main body includes a receiving recess for receiving at least the first heel extension portion, the second heel extension portion and the third heel extension portion therein.

10. The tunable rigidity insole with interchangeable stiffeners according to claim 8, further comprising a fourth rigid stiffener having a structure identical to a structure of the first rigid stiffener, a fifth rigid stiffener having a structure identical to a structure of the second rigid stiffener, and a sixth rigid stiffener having a structure identical to a structure of the third rigid stiffener.

11. The tunable rigidity insole with interchangeable stiffeners according to claim 10, wherein the first rigid stiffener, the second rigid stiffener, the third rigid stiffener, the fourth rigid stiffener, the fifth rigid stiffener and the sixth rigid stiffener are made of any one of a material of a glass fiber, a blended carbon fiber or a metal material or a combination thereof.

12. The tunable rigidity insole with interchangeable stiffeners according to claim 10, wherein the first rigid stiffener is configured to be assembled into the arch pad main body, and the fifth rigid stiffener is engaged with the plurality of second engaging holes.

13. The tunable rigidity insole with interchangeable stiffeners according to claim 10, wherein the second rigid stiffener is configured to be assembled into the arch pad main body, and the fourth rigid stiffener is engaged with the plurality of first engaging holes or the sixth rigid stiffener is engaged with the plurality of third engaging holes.

14. The tunable rigidity insole with interchangeable stiffeners according to claim 10, wherein the third rigid stiffener is configured to be assembled into the arch pad main body, and the fifth rigid stiffener is engaged with the plurality of second engaging holes.

15. The tunable rigidity insole with interchangeable stiffeners according to claim 1, wherein the tunable rigidity insole with interchangeable stiffeners having arch pad main body further comprises at least one forefoot cushion pad in order to distribute the pressure of forefoot and increase shock absorption of the tunable rigidity insole with interchangeable stiffeners.

* * * * *